United States Patent [19]

Chumanov et al.

[11] 4,288,907

[45] Sep. 15, 1981

[54] METHOD OF MAKING BILLETS

[76] Inventors: Julian M. Chumanov, ulitsa Rozy Ljuxemburg, 65, kv. 33, Donetsk; Anatoly L. Liberman, Teply stan, 5 mikroraion, korpus 65, kv. 259, Moscow; Vladimir I. Listopad, Schelkovsky proezd, 7, korpus 1, kv. 51, Moscow; Vasily V. Polyakov, Kosinskaya ulitsa, 18, korpus 3, kv. 19, Moscow; Vyacheslav F. Gubaidulin, ulitsa Schorsa, 23, kv. 16; Grigory M. Shulgin, ulitsa Izjumovskaya, 5, kv. 232, both of Donetsk; Dmitry P. Evteev, ulitsa Chelyabinskaya, 10/2, kv. 137, Moscow; Sergei P. Efimenko, bulvar Pushkina, 29, kv. 18, Donetsk; Veniamin V. Fulmakht, ulitsa Novolesnaya, 6, kv. 16, Moscow; Vladimir P. Slednev, ulitsa Artema, 147 "V", kv. 16, Donetsk; Viktor I. Pogorzhelsky, ulitsa Mironovskaya, 26, kv. 57, Moscow; Valentin B. Shum, ulitsa Artema, 169, kv. 21; Anatoly A. Tolpa, ulitsa Tkachenko, 85, both of Donetsk, all of U.S.S.R.

[21] Appl. No.: 919,785

[22] Filed: Jun. 28, 1978

[51] Int. Cl.[3] ..... B22D 11/126

[52] U.S. Cl. ..... 29/527.6; 29/527.7; 29/33 C

[58] Field of Search ..... 29/527.7, 33 C, 527.6, 29/526.2, 526.3, 526.4, 526.5, 526.6; 72/DIG. 12; 164/269, 270

[56] References Cited

U.S. PATENT DOCUMENTS

| | | | |
|---|---|---|---|
| 942,489 | 12/1909 | Dods | 29/527.6 X |
| 1,586,632 | 6/1926 | McConway | 29/526.6 |
| 1,792,581 | 2/1931 | Firth | 29/526.4 |
| 2,074,712 | 3/1937 | Tross | 29/526.6 |

FOREIGN PATENT DOCUMENTS

| | | | |
|---|---|---|---|
| 559412 | 9/1932 | Fed. Rep. of Germany | 29/526.4 |
| 697670 | 11/1930 | France | 29/526.2 |
| 444309 | 3/1936 | United Kingdom | 29/526.5 |

*Primary Examiner*—Nicholas P. Godici
*Assistant Examiner*—V. Rising
*Attorney, Agent, or Firm*—Steinberg & Raskin

[57] ABSTRACT

A method of making billets, whereby a composite billet is produced by continuous casting or rolling, which billet is star-shaped in cross section and has at least two ray members disposed symmetrically relative to the central longitudinal axis of the composite billet; the base of each star ray member of the composite billet at the place of its juncture with the central portion thereof is selected to be 0.72 to 2.3 of the ray member height, the other base being 0.5 to 1.0 of the ray member height, the lateral sides of the ray member may differ in length; the segregation zone is caused to concentrate in the central portion of the composite billet selecting appropriate relationship between geometric dimensions of the composite billet and by creating favorable conditions for producing the composite billet; thereafter, the ray members are severed from the central portion of the composite billet by means of rolls in a rolling mill, this being performed by subjecting one of the lateral sides of the ray member to the action of an appropriately grooved roll.

10 Claims, 58 Drawing Figures

METHOD OF MAKING BILLETS

BACKGROUND OF THE INVENTION

1. Field of the Application

The present invention relates to metallurgy, and more particularly to a method of making billets for subsequent rolling at bar-, and tube-rolling mills.

The invention is readily adapted for use where billets are produced by continuous casting of metal, which is either followed by, or combined with, the rolling of said billets from high-alloy steels and alloys.

2. Description of the Prior Art

It is modern practice to produce billets by the method of continuous casting of semi-finished products. It should be observed that along with structural stability and chemical homogeneity of the continuously-cast billet over its length, it also has a developed area of axial porosity and segregation of chemical constituents in the transverse section thereof. At present, there are no methods known to have sufficient effect on the metal in the process of continuous casting to prevent axial segregation. The central portion of the continuously-cast billet is of special importance for the production of individual billets separated therefrom, the performance of which depends on the extent of axial segregation developing, for example, in the process of making ball-bearing-, tool-, and corrosion-resistant steels. The preservation of axial segregation in the rolled sections and bars made of high-alloy tool steels renders them unsuitable for the application where macro, and microstructure is under stringent control, the segregation may be caused, for example, by non-uniformity of carbide. Non-uniform distribution of carbon and alloying components in the finished product will result in the non-uniform distribution of carbide phase. Local concentration of carbides and the carbide banded structure greatly impair the operational properties of the finished product. If carbide has banded structure, the cutting edge of a cutting tool tends to become friable, which adversely affects its durability.

It should be noted, however, that the method of continous casting is far more effective than other conventional methods of making billets. Thus, it is essential to develop a method for the production of billets free from macrodefects due to shrinkage, which will make it possible to prolong durability and improve reliability of the finished product at reduced production cost, the features long anticipated by both producers and consumers of high-quality steels.

There is known a method of making billets for special-purpose articles which demand perfectly homogeneous and dense metal. According to this method, a casting is produced in a mould and is then subjected to rolling on a roughing mill, whereafter the riser portion is cut off.

The method referred to above is disadvantageous in that it entails an appreciable waste of metal, above 20 percent, plus additional expences required for making the casting into a billet. Therefore, the production cost of the finished product is rather high.

For the most demanding applications electroslag melting methods are resorted to, though in this case the production cost of metal raises 2 to 2.5 times as compared to the method described above.

Another widely practiced method of making special-purpose billets consists in that metal-cutting lathes are used to remove a developed area of axial porosity and segregation. The billet is separated in the direction of its length into two or three sections, with the area of axial segregation being then removed therefrom by planing. This method is alternatively used for the production of hollow articles, for example, such as high-pressure boilers.

This being the case, the axial portion of the billet is drilled out and the billet is then drawn over mandrels. Needless to say that the mechanical operations required to remove axial porosity and the ensuing segregation substantially add up to the production cost of the finished product.

There is known a more advanced method of continuous casting, wherein the continuous casting is subjected to deformation while having its core still unsolidified.

The disadvantage of the above-mentioned method lies in the impairment of the quality of the cast product due to an increasing concentration of segregates as well as in the occurrence of defects resulting from the disruption of the continuity during reduction of the casting in a two-phase state.

There is known a method of improving the quality of the finished product, according to which a slab is rolled in multi-grooved roll passes, whereby a segregation zone is localized in the middle billet. The extreme billets are free from segregation.

However, the production of good quality billets according to the method described above is accompanied by substantial waste of metal approximating 33 percent, since the middle billet is only suitable for remelting.

The prior-art method of making billets for a cutting tool has found but a limited application. This method consists in producing a casting of rectangular cross section with the ratio of its sides being 1:2, said casting being thereafter separated in the direction of its length and divided into two equal sections. Each of the two sections of the casting is then subjected to working.

The above-mentioned method suffers from a disadvantageously high operating cost due to low production efficiency thereof caused by the cutting operation, as well as considerable waste of metal.

Widely employed in continuous casting machines are multistrand and multipath moulds. By casting metal in the moulds of such construction, billets of planar structure are formed therein which are separated from one another and connected to the central portion of the casting. Resulting therefrom is a star-shaped composite billet.

The amount of metal waste (the central portion) is 15 percent of the overall weight of the casting; in addition, there is no guarantee for the flawlessness of the individual billets severed from the central portion of the casting.

There is known a continuous casting mould which comprises cooled walls defining the mould cavity star-shaped in profile. The mould of this type is used for producing a composite billet star-shaped in cross section and having ray members spaced symmetrically in relation to the central axis.

The disadvantage of the known mould construction lies above all in the formation of the continuous casting, which, when severed into individual billets, results in the lower production output of the finished product free from defects in the axial area thereof. In view of the fact that the width of the base of each section of the mould cavity is larger at the place of juncture with other sections than the oppositely spaced base, the longitudinal separation of the individual billets from the casting is difficult to carry out and is accompanied by substantial waste of metal. With this method it becomes possible to bring the yield of good billets free from macrodefects due to shrinkage only up to 70 percent.

SUMMARY OF THE INVENTION

It is therefore an object of the present invention to eliminate the above disadvantages.

Another object of the invention is to produce good quality billets with the central area thereof being free from defects, while permitting the production cost of such billets to be cut down at valuable extra gains in yield.

These and other objects of the invention are accomplished by the provision of a method of making billets, comprising the steps of producing a composite billet star-shaped in cross section and having ray members disposed symmetrically in relation to the central longitudinal axis of the composite billet, wherein, according to the invention, a segregation zone is removed from the ray members of the composite billet, said segregation being localized in the central portion of the composite billet, whereupon the ray members of the composite billet are severed from the central portion thereof.

The method according to the invention for making billets permits axial porosity and the ensuing segregation to be removed from the ray members of the composite billet.

It is preferred to make the composite billet star-shaped in cross section with at least two ray members each having its base at the place of juncture with the central portion of the composite billet equal 0.72 to 2.3 times the height of the ray member, the other base thereof being 0.5 to 1.0 times the height of the star prong.

Such structure of the composite billet ensures localization of the segregation zone in the central portion thereof. Segregation of chemical components in the transverse section of the ray members is practically nonexistant. In addition, the absence of axial porosity in the ray members results in still lower degree of a minimum permissible reduction of the casting or, in other words, it dispenses with reducing operations to be carried out on roughing mills. Furthermore, with the method of the invention it becomes possible to cut in half the number of continuous casting machines by increasing their production capacity (cross-sectional area).

The composite billet is preferably produced star-shaped in cross section with one of the lateral sides of each ray member thereof being larger than the other one by 3 to 15 percent.

Such configuration of the composite billet permits the quality of the ray members thereof to be improved at the place of their separation from the central portion by preventing the ray members from turning during their separation.

According to one embodiment of the invention, the ray members of the composite billet star-shaped in cross section are severed simultaneously from the central portion thereof.

It is to be noted that the expenses required for the severing operation are completely compensated for by employing a smaller number of continuous casting machines.

According to another embodiment of the invention, the separation of the star-shaped composite billet having three ray members is carried out by initially severing two ray members and then by severing the central portion from the remaining ray member.

Such pattern of severing the ray members from the composite billet makes it possible to intensify the severing operation.

It is sometimes advantageous to sever the ray members from the central portion of the composite billet one after another by subjecting one of the lateral sides of the ray member to the action of a grooved roll.

In this case it becomes possible to make use of the available equipment, i.e. rolling mills, without the need of redesigning the latter, which drastically cuts down the cost required for severing the ray members from the star-shaped composite billet.

If after shifting the star prong for a distance of 0.57 to 0.92 times the height of the ray member the shifting direction is reversed, the quality of surface of the ray members will be improved at the place of severance from the central portion.

It is preferable that a T-section be formed from the composite billet star-shaped in cross section and having three ray members, with two oppositely spaced ray members being severed from said T-section and shifted relative to the remaining portion of the section, whereupon the central portion of the composite billet is severed from the remaining ray member.

Owing to this procedure the production capacity of a rolling mill is enhanced as the ray members are severed from the composite billet.

In certain cases the procedure may vary in that initially two oppositely spaced ray members are severed from the star-shaped composite billet with four ray members, said separation being effected by creating a shearing strain in the rolls of a rolling mill, whereupon the two remaining ray members are severed from the central portion of the composite billet.

Such procedure makes it possible to produce billets with high dimensional accuracy at a high production rate of a rolling mill.

It is preferred that a composite billet be produced star-shaped in cross section and with four ray members, with the ratio of axial dimensions of the mutually perpendicular ray members being 1.05 to 1.5, ray members wherein two smaller-in-height oppositely spaced are severed concurrently with the reduction of the remainder portion of the billet, whereupon smaller ray members, exceeding in cross sectional area by 1.05 to 1.5 times the billets produced from said ray members, are severed.

As a result, the yield of good billets is increased and the severing operation is rendered more simple.

Prior to producing a composite billet, a continuous casting is preferably formed rectangular in cross section with the ratio of its sides being 1.0 to 1.8, said continuous casting undergoing rolling to be thereby formed into a composite billet star-shaped in cross section and having four ray members with the height thereof being less than one third of the side of the continuous casting and with the ratio of axial dimensions of the mutually perpendicular ray members being 1.0 to 2.8, whereupon the ray members are severed from the central portion of the composite billet.

This being the procedure, the process of continuous casting is simplified and the yield of good billets free from macrodefects due to liquation is increased.

According to another embodiment of the invention, the segregation zone is initially removed from the ray members of a composite billet, whereafter each of the ray members is reduced in thickness by 10 to 30 percent in the direction perpendicular to the radius of the ray member, and by introducing the segregation zone into the ray member, the central portion of the composite billet is subjected to reduction together with the ray members, whereupon the ray members, with the height thereof being 1.02 to 1.5 times the original height, are severed.

As a result, the process of severing the ray members from the central portion of the composite billet is considerably simplified.

According to still another embodiment of the invention, a composite billet star-shaped in cross section and having two ray members is produced from a continuously-cast slab with the ratio of its sides being 1.05 to 2.0, the continuously-cast slab is subjected to reduction in the area where segregation is concentrated, with the segregation zone being localized in the central portion being in thickness 0.3 to 0.1 times that of the slab and in width 0.4 to 0.7 times the thickness of the slab, whereupon the ray members of the composite billet are severed from the central portion thereof.

This enables an increase in the production of billets with macrostructure thereof being free from defects.

The separation of the ray members of the composite billet from the central portion thereof is preferably effected with the metal temperature being 0.37 to 0.48 times the metal melting temperature by causing the ray members to shift by 40 to 65 percent relative to their original position.

Such temperature conditions make for more intensive process of separation of the ray members.

Similar effects can be obtained if prior to severing the ray members of the composite billet from the central portion thereof stress raisers such as indentations are formed at the place of juncture of the ray members, with the depth of said indentations being 0.07 to 0.2 times the height of the ray member and with the width thereof being 0.02 to 0.1 times the height of the ray member.

The invention will be further described, by way of example only, with reference to the accompanying drawings, wherein:

DETAILED DESCRIPTION OF THE PREFERRED EMBODIMENTS

Figure 1:
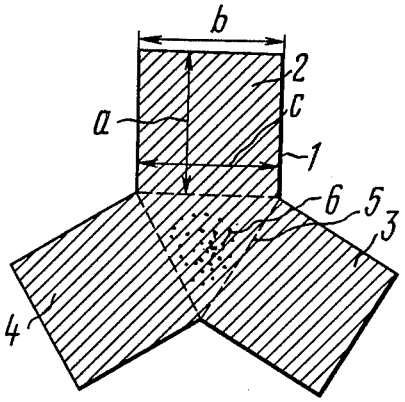
FIG. 1 is a cross-sectional view of a composite billet star-shaped in cross section and having three ray members.

As above-indicated, the present invention is concerned with the manufacture of billets. For this purpose a continuous casting machine is used for producing a composite billet 1, such as shown in FIG. 1. Let us assume that the billet is made up of several parts, such as ray members 2,3,4 and the central portion 5. In other words, the billet 1 is star-shaped in cross section and has a plurality of ray members, in the given case three ray members 2, 3, and 4, which are connected with the central portion 5. The members 2, 3 and 4 are disposed symmetrically with respect to the center of the composite billet 1, i.e. the angles between the lateral sides of the members 2, 3 and 4 are equal. The removal of a segregation zone 6 from the members 2, 3 and four and its localization in the central portion 5 of the composite billet 1 is carried out by selecting an appropriate dimensional relationship of the composite billet 1. The ray members 2, 3 and 4 will be free from any defects in the axial area due to shrinkage or segregation provided the base "c" of each ray member 2, 3 and 4 at the place of juncture with the central portion 5 is 0.72 to 2.3 times the height "a" of the ray member 2, 3 and 4, the other base "b" of said ray members 2, 3 and 4 being 0.5 to 1.0 time the height "a" of the ray member. When severing the ray members 2, 3 and 4 from the central portion 5 of the composite billet 1, the amount of metal waste due to the necessity of remelting the central portion 5, is drastically cut down. The yield of good quality billets formed from the ray members 2, 3 and 4 amounts to 90 percent.

It has been found that with the base "c" of the ray members 2, 3 and 4 at the place of juncture with the central portion 5 being less than 0.72 time the prong height $/c/a<0.72/$, porosity or segregation are likely to appear in the axial area of the ray members 2, 3 and 4. On the other hand, if the base "c" of the ray members 2, 3 and 4 at the place of juncture with the central portion 5 is more than 2.3 times the height "a" of the ray members 2, 3 and 4 $/c/a>2.3/$, the yield of good quality billets free from defects in the axial area is found to be less than 75 percent. If the base "b" of the ray members 2,3 and 4 is less than 0.5 times their height, the axial area of the ray members will show the appearance of the defects due to shrinkage and the places enriched with segregated due to the formation of bridges during crystallization between the ray members 2, 3, 4 and the central portion 5. With the base "b" of the ray members 2, 3 and 4 exceeding 1.0 time the height "a" of said ray members $/b/a>1.0/$, the yield of the finished product is found to be less than 80 percent. Therewith, the waste of metal is likewise increased in the process of separation of the ray members 2, 3 and 4 from the central portion 5 of the composite billet 1.

Where a continuous casting machine is used for producing a composite billet star-shaped in cross section and having three ray members, with dimensional relationship being $c/a=0.72$ and $b/a=0.72$, the yield of good billets, upon separation of the ray members, will amount to 90.6 percent.

Figure 2:
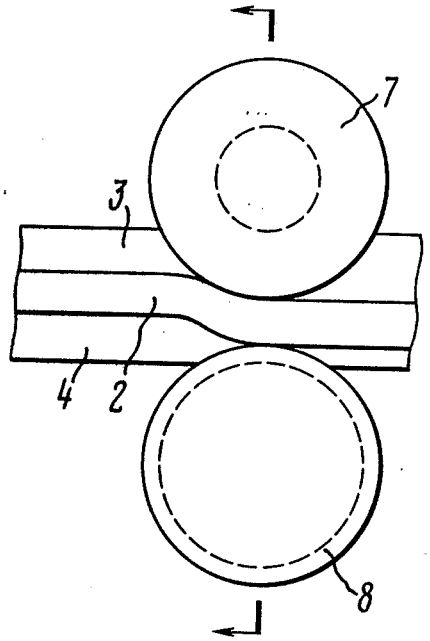
FIG. 2 schematically illustrates the separation of the ray members of a composite billet, effected by means of rolls in a rolling mill.
Figure 3:
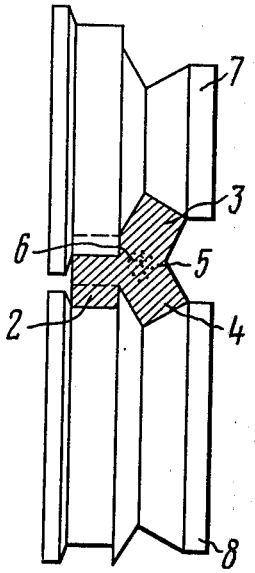
FIG. 3 is a cross-section taken along line I—I of FIG. 2.

The separation of the prongs from the central portion of a composite billet is considered to be the most difficult operation in the billet making process. It should be observed that rolls of a rolling mill were found to be the most suitable equipment for effecting the severing operation. As mentioned above, a continuous casting machine is used for producing the composite billet 1, with the segregation zone being concentrated in the central portion 5, whereas the axial area of the ray members 2, 3 and 4 is free from defects. The continuous casting 1 is cut to lengths, which are preheated to a temperature of rolling and then fed to a passline. When engaged by rolls 7 and 8 (FIG. 2) of a rolling mill, the ray member 2 is displaced relative to the ray members 3, 4 and to the central portion 5 (FIG. 3). The displacement of the ray member 2 is effected by means of the grooved roll 7 operable to reduce the lateral side of the ray member 2. As this happens, the ray members 3 and 4, as well as the central portion, are retained in vertical position by means of the rolls 7 and 8.

Figures 4, 5, 6, 7, 8, 9, 10, 11:
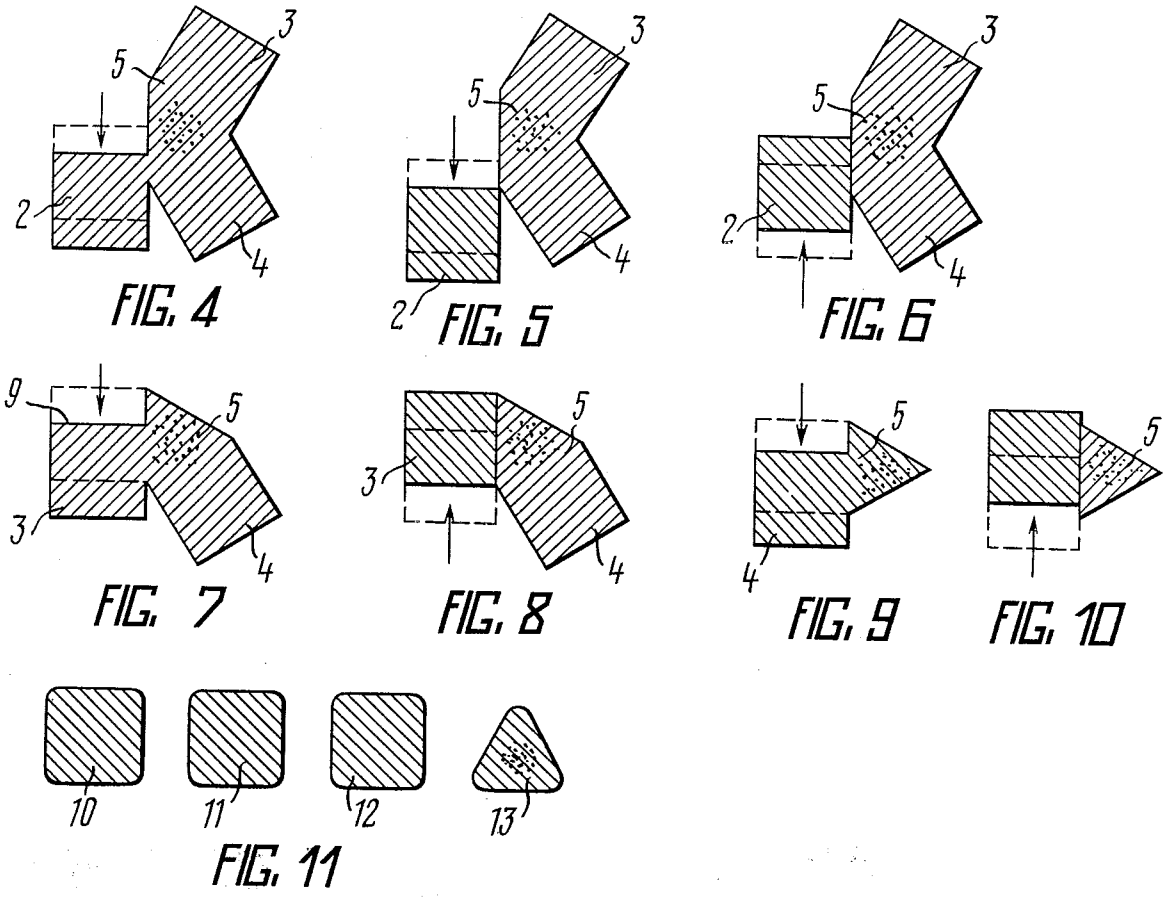
FIGS. 4 and 5 same as in FIG. 2, next stage of the severing operation.
FIG. 6 schematically shows the operation of severing the ray members of a composite billet, wherein use is made of an anti-shifting device.
FIG. 7 schematically illustrates next stage of severing the ray members from a composite billet after one of the ray members has been severed.
FIG. 8 same as in FIG. 7, the shifting being effected in the opposite direction.
FIGS. 9 and 10 schematically illustrate the final stage of separation of the ray members of a composite billet from the central portion thereof.
FIG. 11 is a view of individual billets resultant from the separation of a composite billet.

The amount of shear to which the ray member 2 is subjected during its separation from the central portion is determined by the strength properties of the rolling mill equipment and by the type of the roll gap used for engaging the metal. In the course of rolling (FIGS. 4 and 5), the ray member 2, acted upon by the grooved roll 7 (FIG. 3), is completely severed from the central portion 5 (FIGS. 4, 5). However, the direction of shear strain, after the ray member 2 has been displaced for a distance of 0.57 to 0.92 times the height of the ray member, is preferably reversed, such as shown in FIG. 6. If only one grooved roll was used for effecting the reduction and displacement, this function is now effected by the oppositely arranged roll. In the given case the rolling force is decreased, the angles of the separated ray members are rounded off, and the places of separation at the base of the severed ray member is of better quality. The most suitable position for effecting separation of the ray members from a composite billet is the one at which the lateral side of the ray member being severed is disposed in parallel with the axis of a roll. Therefore, upon severing the ray member 2 from the central portion 5, the workpiece is turned about the longitudinal axis through 120 deg. Further, the ray member 3 (FIG. 7) is worked upon by the grooved roll 9 and is thus severed from the central portion 5 (FIG. 8). Then, the ray member 4 (FIG. 9) is separated in similar manner from the central portion 5 (FIG. 10). The resultant three billets 10, 11 and 12 (FIG. 11) are free from macrodefects due to shrinkage, which billets are further processed to be adapted for the most demanding applications. In addition, a central portion 13, enriched with segregates, is formed as a result of separation, which is then delivered to a steel casting shop for remelting.

It has already been mentioned that a continuous casting machine is used for forming a star-shaped composite billet having three ray members, which ray members are then severed by means of grooved rolls of a rolling mill. The ray members of the composite billet are free from macrodefects due to shrinkage. The lateral sides of each of said ray members differ at the base thereof by 3 to 15 percent. The relationship of 1.03 to 1.15 between the lengths of the lateral sides of the ray members makes it possible for the segregation zone to be concentrated in the central portion of the composite billet, which facilitates the process of separation, since the ray member being separated is prevented against turning in the roll pass.

Figure 12:
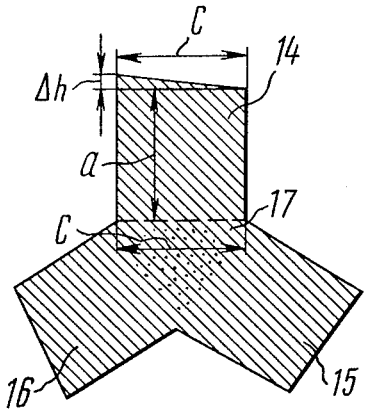
FIG. 12 is a cross-sectional view of a composite billet with ray members, the lateral sides of which have different lengths.
Figure 13:
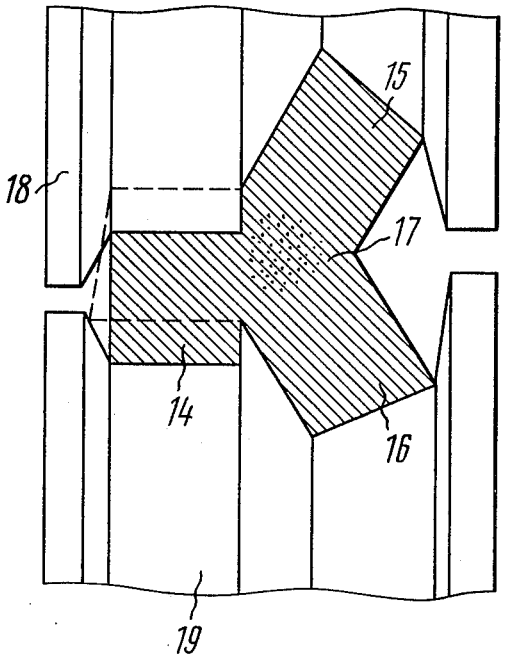
FIG. 13 schematically illustrates the process of severing a ray member from the composite billet shown in FIG. 12.

A composite billet with ray members 14, 15, 16 (FIG. 12) is fed to the passline of a rolling mill, where the ray members 14, 15, 16 are severed from a central portion 17 of the composite billet. Each ray member 14, 15, 16 is made in the form of rectangular trapezium, the base of which at the place of juncture with the central portion 17 equals "c". The other base of the ray members 14, 15, 16 is also equal to "c", whereas the lateral sides of the ray members 14, 15, 16 are perpendicular to the base at the place of juncture with other ray members. One of the lateral sides of the ray members 14, 15, 16 is equal to "a", and the other one to "a"$+\Delta h$, with $\Delta h$ constituting 3 to 15 percent of "a". If the separation is effected by means of rolls 18 and 19 (FIG. 13) of a two-high mill, a force is created due to the difference in lengths of the lateral sides of the ray member 14, which prevents the ray member 14 from turning as the latter is being severed from the central portion 17. The distortion of shape of the ray members is thereby excluded and favourable conditions are created for the flawless severance while the ray member 14 is displaced relative to the central portion 17.

Figure 14:
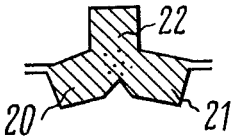
FIGS. 14, 15 schematically illustrate the process of formation of a T-section from a composite billet with three ray members.
Figure 15:
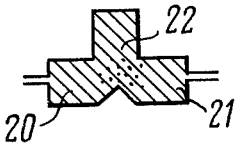
Figure 16:
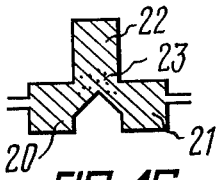
FIGS. 16–18 schematically illustrate the process of simultaneous separation of ray members from a three-member composite billet.
Figure 17:
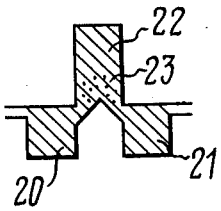
Figure 18:
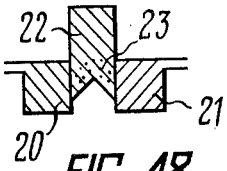
Figure 19:
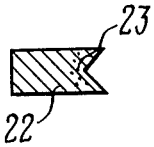
FIGS. 19–21 schematically illustrate the process of separation of the central portion from the ray members of a composite billet.
Figure 20:
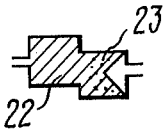
Figure 21:
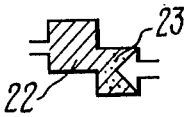

If turns out to be more suitable to separate the ray members from a three-member star-shaped composite billet by preliminary forming it into a T-shaped section. For this purpose a three-member composite billet is produced at a continuous casting machine, and, provided the base of the ray member at the place of juncture with the central portion is 0.72 to 2.3 times the height of the ray member, and the other base of the ray member is 0.5 to 1.0 times the height of the ray member, then the entire segregation zone will be localized in the central portion of the composite billet. Ray members 20, 21, 22 of the composite billet are free from axial porosity and from the segregation associated therewith, the metal being of sufficiently dense and homogeneous structure. When worked in the first and second passes of a rolling mill, the ray members 20 and 21 (FIGS. 14, 15) are turned relative to the ray member 22 until the lateral sides of the ray members 20 and 21 are perpendicular to the axis of rolls of the rolling mill. In the successive roll pass, wherein the lateral sides of the ray members 20 and 21 (FIG. 16) are worked by the edge of the grooved roll, also functioning to prevent the ray member 22 and the central portion 23 from vertical displacement, the ray members 20 and 21 are simultaneously displaced relative to the central portion 23. Thereafter, the amount of relative displacement of the oppositely spaced ray members 20 and 21 in relation to the central portion 23 is increased (FIG. 17). Finally, in the next roll pass, wherein reduction is effected of the lateral sides of the ray members 20 and 21 (FIG. 18) being in opposite space relationship with the reduced sides of said ray members, the ray members 20 and 21 are completely severed from the central portion 23. Thereafter, the workpiece is turned through 90 deg. and the ray member 22 (FIG. 19–21) is severed from the central portion 23 in a manner similar to that described above. The yield of good billets amounts to 87.5 percent.

Where roll-working equipment is not available, it is practicable to effect simultaneous separation of the ray members of a composite billet from its central portion. For this purpose cutting torches are used to sever the ray members from the central portion of the star-shaped composite billet having three equal and symmetrically disposed ray members. The cutting is carried out in the longitudinal direction along the base of the ray members at the place of their juncture with the central portion of said composite billet. It is possible to simultaneously sever the ray members from the central portion of the composite billet by means of flame cutting torches, laser beam cutting apparatus, as well as by means of saws and impulse cutting technique, etc., The severance of the ray members from the three-member star-shaped composite billet is rendered difficult by the necessity to provide special roll fitting, also requiring rolls of complicated design. Continuous rolling mills are preferably used for working a four-member composite billet, which can be produced at a continuous casting machine.

In casting a symmetrical four-member composite casting with the base of each of the ray members at the place of juncture with the central portion being 0.72 to 2.3 times the height of the ray member, the other base thereof being 0.5 to 1.0 times the height of the ray member, axial porosity and the ensuing segregation forming in the solidifying casting will be forced to move to the central part of the casting, which is the last to solidify.

Figure 22:
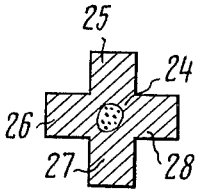
FIG. 22 is a cross-sectional view of a four-member composite billet.
Figure 26:
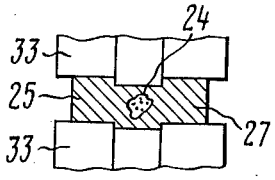
FIGS. 26–28 schematically illustrate the process of separation of the central portion from the ray members of a four-member composite billet after two ray members have been severed.
Figure 23:
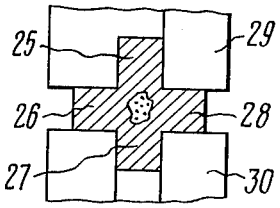
FIGS. 23–25 schematically illustrate the process of separation of the ray members from a four-member composite billet.
Figure 27:
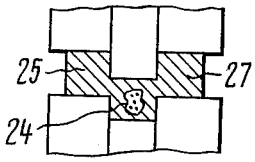
Figure 24:
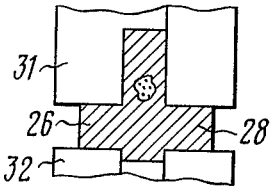
Figure 28:
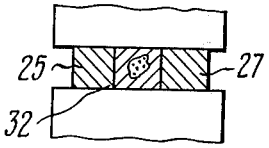
Figure 25:
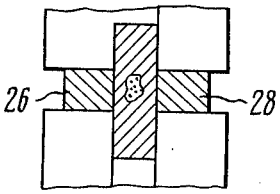
Figure 29:
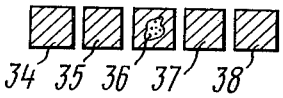
FIG. 29 is a view of individual billets resultant from the separation of the four-member composite billet.

The casting can be divided into five parts, namely, into a central portion 24 (FIG. 22) wherein a segregation zone is formed in the process of solidification, and four ray members 25, 26, 27 and 28 free from porosity and other defects due to segregation. The severance of the central portion of the billet is performed in the following manner. Grooved rolls 29 and 30 (FIG. 23) form a roll pass wherein the ray members 26 and 28 are subjected to shear strain to be thereby displaced relative to the remainder part of the workpiece; in this way the cross-shaped billet is subjected to deformation. The ray members 26 and 28 are subjected to shear strain in the successive roll pass formed by rolls 31 and 32 (FIG. 24). This successive displacement is carried out so as to avoid complete severance of the ray members 26 and 28 from the remaining part of the workpiece. Final severance of the ray members 26 and 28 (FIG. 25) is effected in the rolls by shifting said ray members in the direction opposite to that effected in the preceding roll pass. The remainder part of the workpiece, together with the central portion 24 and the ray members 25 and 27, is subjected to rolling in the roll pass formed by rolls 33 (FIG. 26), whereby the central portion 24 is shifted relative to the ray members 25 and 27. Subsequent shifting operation is carried in the roll pass similar to that shown in FIG. 27, without effecting complete severance of the workpiece. The rolling operation is continued in the roll pass wherein the central portion 24 is shifted in the opposite direction until complete severance of the ray members 25 and 27 from the central portion 24 (FIG. 28). Resulting from this separation are five individual billets 34, 35, 36, 37, 38 (FIG. 29), of which four are free from segregation zone. The billet 36, which has segregation zone, can be adapted for less demanding applications or delivered for remelting.

Figure 30:
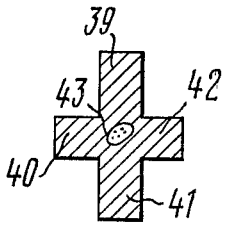
FIG. 30 is a cross-sectional view of a composite billet formed with ray members varying in length.
Figure 31:
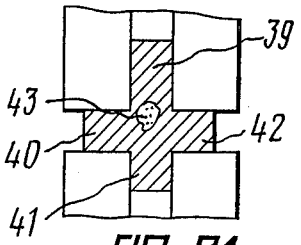
FIGS. 31–33 schematically illustrate the process of separation of the ray members from the composite billet shown in FIG. 30.
Figure 32:
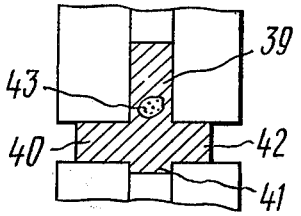
Figure 33:
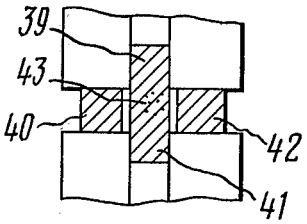
Figure 34:
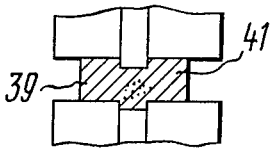
FIGS. 34–36 schematically illustrate the separation of the remaining ray members from the central portion of a composite billet.
Figure 35:
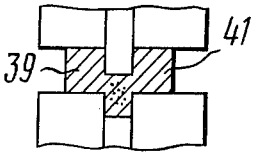
Figure 36:
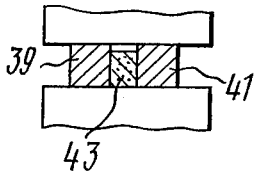
Figure 37:
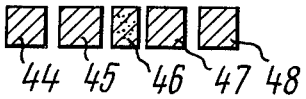
FIG. 37 is a view of individual billets resultant from a composite billet.

Further gain in the yield of good billets produced from a four-member composite billet is attained in the following manner. First, a composite billet is produced by continuous casting. By strictly observing the process parameters specified for the continuous casting process and by appropriately selecting the relationship between the geometric dimensions of ray members 39, 40, 41 and 42 (FIG. 30) and a central portion 43, segregation zone will be concentrated in a central portion 43 of the composite casting. Therewith, at the place of juncture of each of the ray members 39, 40, 41, 42 with the central portion 43 there is formed an area of dense and homogeneous metal. The height of ray members 39 and 41 are 1.05 to 1.5 times greater than the ray members 40 and 42, i.e. the relationship between the heights of the mutually symmetrical ray members is 1.0 to 1.5. The severance of the ray members 39, 40, 41 and 42 from the central portion 43 is carried out in the following manner. As the ray members 40 and 42 (FIG. 31) are displaced by working rolls relative to the remainder part of the workpiece, the ray members 39 and 41 are concurrently worked upon by the same rolls. Shown in FIG. 32 is one of the intermediary phases of the rolling or severing operation. The reduction of the composite billet is performed so as to avoid complete severance of the ray members 40 and 42 from the remainder part of the workpiece. The severing operation is effected in the roll pass (FIG. 33) wherein the ray members 40 and 42 are displaced in the opposite direction as the prong members 39 and 41 are concurrently subjected to reduction. Such pattern of rolling makes it possible to effect reduction of the central portion 43, whereby it is strengthened and reduced in cross section. The rolling operation is further continued to effect separation of the ray members 39 and 41 (FIGS. 34–36) by displacing and counterdisplacing said ray members relative to the central portion 43. Out of the severed individual billets 44, 45, 46, 47, 48 (FIG. 37) only four billets 44, 45, 47 and 48 are suitable for further rolling.

Figure 38:
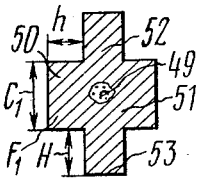
FIG. 38 is a cross-section of a composite four-member billet.
Figure 39:
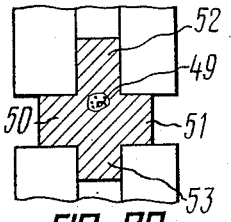
FIGS. 39–41 schematically illustrates the separation of the ray members from the central portion of a composite billet.
Figure 40:
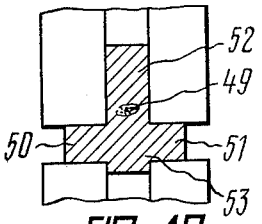
Figure 41:
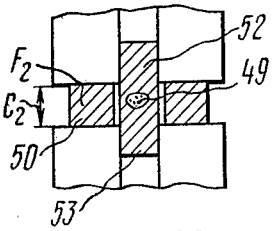
Figure 42:
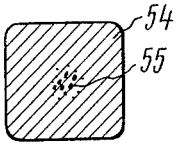
FIG. 42 is a cross-section of a composite billet.

Similar effect can be obtained in the following manner. A cross-shaped billet which has a central portion 49 (FIG. 38) and four ray members 50, 51, 53 is produced at a continuous casting machine. Each of the ray members 50 and 51 is formed to have cross-sectional area $F_1$ thereof 1.05 to 1.5 times larger than the cross-sectional area $F_2$ of the individual billets resultant from the severed ray members 50 and 51. The change in the cross-sectional area of the ray members is carried out by changing dimension $C_1$ as compared to dimension $C_2$. The limits within which the dimensional relationship $H/h=1.05$ to 1.5 can be varied depend upon the following factors. The lower limit 1.05 is selected in accordance with a requisite amount of shear strain applied vertically to the vertical member of the composite billet in the course of rolling, this being the result of the metal reaction of the forces required to induce shearing strain of the ray members 50 and 51. At the final stage of shear strain there takes place complete severance, a minimum amount of shearing strain ranging from 1.1 to 1.05. The upper limit 1.5 of said dimensional relationship is selected in accordance with the conditions of solidification of the composite casting. While the ray members 50 and 51 (FIGS. 39–41) are being severed, they undergo deformation in the direction of their bases and are thus reduced in cross section.

Where it is advantageous to standardize a continuously-cast billet containing a broad range of special alloy steels, a casting 54 is produced (FIG. 42) which is rectangular in cross section, with the relationship of the sides thereof being 1.0 to 1.8. Axial porosity and the ensuing segregation of chemical elements concentrate in the central portion of the casting 54. A segregation zone 55 has the form of ellipse in cross section, with the relationship of its axes depending on the relationship of the sides of the casting 54. It has been found that with the relationship of the dimensions of the sides of the casting 54 being within the range of 1.0 to 1.8, the segregation zone has the form of ellipse or circle the area of which is 6 to 10 percent the cross sectional area of the casting. As a rule, with the continuous casting being rectangular in cross section, the segregation zone has the form substantially of a circle the diameter of which does not exceed one third of the casting side. If the continuous casting process parameters are strictly observed, segregation will be maintained within the limits specified for the permissible composition of special alloy steel, however, its presence adversely affects mechanical properties of steel; its grain size is increased and the uniformity of its structure is impaired. Where billets are produced from ball-bearing steels and other special steels, it becomes essential to produce billets with the central area thereof being free from defects, wherein there would be no segregation zone, these factors having an important bearing on the performance characteristics of the finished product.

Figure 43:
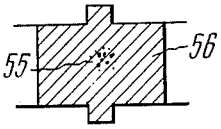
FIGS. 43–45 schematically illustrate the process of formation of a cross-shaped composite billet.
Figure 44:
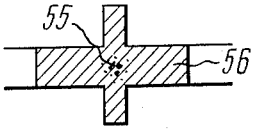
Figure 45:
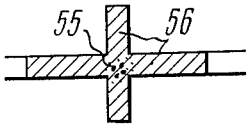

Since the problem of complete removal of segregation zone in the process of casting has not been solved, it is deemed expedient to do away with the segregation zone during subsequent reduction. For this purpose the casting 54 is subjected to working in a plurality of roll passes (FIGS. 43–45), whereby a cross-shaped section is formed therefrom. The casting formation is carried out in the rolls of a rolling mill, for example, in those of a two-high reversing-blooming mill. The segregation zone 55 is concentrated in the central portion of the cross-shaped billet 56.

In the course of formation of the cross-shaped billet 56, the horizontally extending ray members thereof (the sections being reduced) are divided by critical cross-section into the sections which adjoin the central portion of the billet; as a result of transverse displacements, the metal flows over to the central portion of the billet. Owing to this, the segregation zone 55 is elongated across the width. Taking into account that all the elements of the billet have the same reduction ratio, interacting both longitudinally and transversely, the share of the casting-cross sectional area under segregation zone remains unchanged in the process of the casting formation. If the composite billet is formed without being periodically turned about its longitudinal axis, then the relationship between the lengths of the mutually perpendicular ray members may be as high as 2.8, which prevents standardization of the billets being produced. The cross-shaped section is formed by being periodically turned through 90 deg., whereby the mutually perpendicular ray members are made equal in length.

The linear dimension of the segregation zone is decreased with increasing reduction, which is why the base of each of the ray member in the original casting is initially less than the width of the segregation zone. Taking into account that the reduction ratio in the process of formation of the cross-shaped casting ranges from 1.5 to 2.0, the base thereof is selected to be a $=(0.5\text{–}0.9)\ D$, where a is the height of the ray member base;

D is the diameter of the segregation zone in the original casting.

Figure 46:
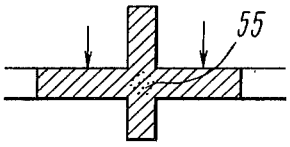
FIGS. 46, 47 schematically illustrate the process of separation of ray members.
Figure 47:
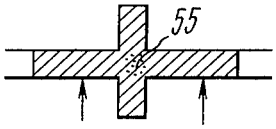
Figure 48:
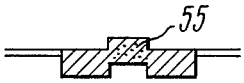
FIG. 48 schematically illustrates next stage of separation of the remaining ray members from the central portion.
Figure 49:
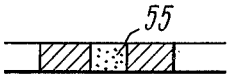
FIG. 49 schematically illustrates the final stage of separation of the ray members.

The cross-shaped billet is then worked in a roll pass of a rolling mill in such a manner that two diametrically opposite ray members (FIGS. 46 and 47) are displaced until their complete severance. Thereafter, the workpiece is turned through 90 deg. and the two remaining ray members are severed from the central portion (FIGS. 48, 49).

The above-indicated sequence of operations permits the waste of metal to be minimized and the segregation zone to be dispensed with. The amount of metal waste depends practically on the shape and size of the segregation zone in the original casting.

Figure 50:
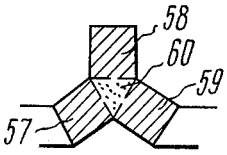
FIGS. 50, 51 schematically illustrate the procedure of elongation of the ray members of a composite billet by introducing segregation zone into said ray members.
Figure 51:
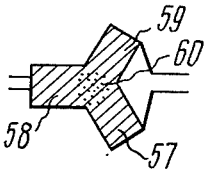

In the event of severing ray members from a three-member composite billet, the following operation pattern is suggested. Ray members 57, 58 and 59 (FIG. 50 and 51) are reduced by 10 to 30 percent along with the reduction of a central portion 60 adjoining each of the ray members 57, 58 and 59. As a result, the base of each of the ray members 57, 58 and 59 is reduced in cross section, while the metal of the central portion 60, rich in segregates, is transferred to the ray members 57, 58, 59.

Figure 52:
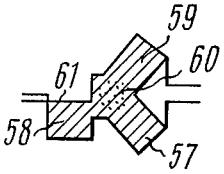
FIGS. 52, 53 schematically illustrate the separation of a ray member from a three-member composite billet.
Figure 53:
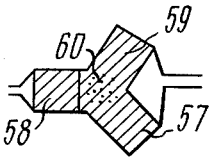
Figure 54:
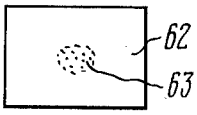
FIG. 54 is a cross-section of a slab.
Figure 55:
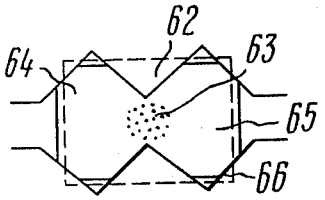
FIGS. 55–57 schematically illustrate the process of formation of a composite billet.
Figure 56:
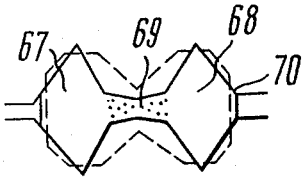
Figure 57:
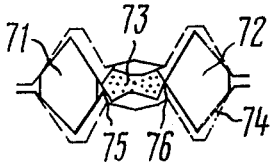

The extent of penetration of the segregation zone in the ray members 57, 58, 59 depends upon the length of the sections of the central portion 60, which are subjected to reduction simultaneously with the ray members 57, 58, 59, as well as upon the degree of deformation. Thus, the ray members are elongated at the place of their juncture with the central portion 60. The share of the cross-sectional area under segregation remains unchanged. Then, the ray member 58 (FIGS. 52–53) is severed from the central portion 60. By effecting reduction of the lateral side of the ray member 58 in the direction perpendicular to its radius, i.e., in the axial direction, the action of a roll 61 is not extended over the entire length of the ray member 58, but over the section of metal free from macrodefects due to segregation. Taking into account the fact that the workpiece is prereduced by 10 to 30 percent, and that the length of the lateral side of the ray members 57, 58, 59 is increased by 2 to 50 percent of the original length thereof due to reduction and elongation of said ray members 57, 58 and 59, the elongation of the lateral side of the ray member 58 by 1.02 to 1.5 times its original length makes it possible to attain the desired effect, namely, to produce a high-quality billet. Also, the process of severing the ray members is substantially simplified by preventing the ray member under shearing strain from effecting other members of the billet. When subjected to shearing strain, the ray member 58 is retained within the section adjoining the central portion 60, wherein segregation zone is concentrated. As a result of this, the ray member 58 is displaced without any deformation of the ray members 57 and 59. In other words, the central portion of the billet is used to effect elongations of the ray members 57, 58 59, which serve as support members during separation of the ray members 57, 58, 59 from the central portion 60, effected through mutual displacement thereof. Where a continuous casting machine is used for producing a slab, high-quality bar sections can be produced therefrom in the following manner. An original continuously-cast slab 62 (FIG. 54) has a segregation zone 63 which is concentrated in its central portion. The height of the segregation zone 63 is about 0.3 times its width. Then, the central portion of the slab is separated and the composite billet made up of two ray members 64 and 65 (FIG. 55), is formed by rolls 66 of a rolling mill. The separation of the central portion of the original slab 62 is effected by reducing the latter over a zone 63 wherein segregation is concentrated. Thereafter, a composite billet is formed which is composed of two ray members 67 and 68 (FIG. 56) connected with a central portion 69, with the width thereof being 0.3 to 0.1 time the height of the original slab 62. The composite casting is worked in the two-groove roll pass of rolls 70, whereby segregation is transferred to the oppositely spaced sides of the composite billet and is then concentrated in the central portion 69, with the width thereof being 0.4 to 0.7 time the height of the original slab 62. The reduction of the slab 62, effected substantially in the region of concentration of segregation until it reaches a thickness of 0.3 to 0.1 times the height of the slab 62, permits the segregation zone 63 to be brought out onto the surface of the central portion 69 with allowance made for its reduction in height during rolling. When the segregation zone 63 is opened, it is both elongated and increased in width. The formation of the central portion 69 of the composite billet, with the width thereof being 0.4 to 0.7 time the height of the original slab 62, enables the segregation zone 63 to be localized in the central portion 69, taking into account the widening ability of the segregation zone 63 in the process of rolling, which depends on the relationship between the sides of the original slab varying within the range of 1.05 l to 2.0. After the segregation zone 63 is concentrated in the central portion 69 of the composite billet, the workpiece is formed in a roll pass 74, which consists of two ray members 71 and 72 (FIG. 57) connected with a central portion 73 wherein a minimum amount of metal free from segregates is concentrated at places 75 and 76 of juncture of the ray members 71 and 72 with the central portion 73. Thence, the ray members 71 and 72 are severed from the central portion 73, for example, by using saws for cutting the workpiece in the direction of its length at the places shown at 75 and 76. If the severing operation is effected in the roll pass of a rolling mill, wherein one of the ray members is held in position while the adjacent ray members are shifted under the action of the reducing edge of the roll pass, then the process parameters, as well as its efficiency, will be determined substantially by the temperatures conditions of the process. An increase in temperature will result in substantially higher degree of mutual displacement of the ray members, which is required to enable severing of the ray members from the central portion of the billet. A drop in temperature will greatly enhance resistance to the relative displacement of the ray members, this necessitating a higher power input and greater rolling force required for the severing operation. The severing operation is preferably conducted, where high-alloy steels are used, within a temperature range of 570° to 740° C., which is 0.37 to 0.48 time the metal melting temperature. Therewith, the extent of displacement of the ray members does not exceed 65 percent. In this case it is deemed advantageous to combine the continuous casting process with the rolling process, whereby the continuously-cast composite billet is first formed and the ray members are then severed therefrom.

Figure 58:
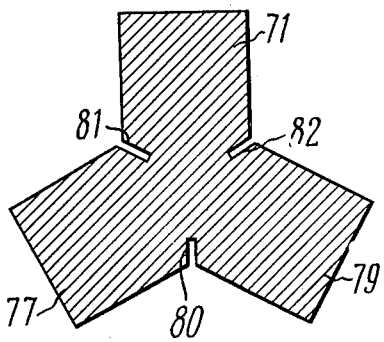
FIG. 58 is a cross-section of a composite billet formed with stress raisers or indentations.

Notwithstanding the method of severing the ray members of a composite billet from the central portion thereof, it is always essential to form stress raisers or indentations at the places of juncture of ray members 77 and 78, 78 and 79, 79 and 77 (FIG. 58). The stress raisers or indentations may take any form. For example, the stress raisers can be formed as indentations 80, 81 and 82. The depth of the indentations 80, 81 and 82 should be 0.7 times less than the height of the ray member, and their maximum width and depth are restricted by the operating conditions required for the formation of such stress raisers. During subsequent severance of the ray members 77, 78 and 79, effected in the roll pass of a rolling mill, the indentations 80, 81 and 82, will considerably facilitate the severing process.

With the method of the invention it becomes possible to produce continuous castings free from axial porosity and segregation. Apart from ensuring the production of high-quality billets, the present invention is highly efficient. Owing to improved quality of metal, the most effective method of severance and enhanced production capacity of continuous casting machines enabled by the present invention, the production cast of the finished product is reduced 17 to 21 percent whereas the expenses required for further working of the central portion of the casting increase the production cost only by about 7 percent.

In view of the absence of the practically applicable methods for removing segregation during the casting solidification, and particular solution to the problem, described in the present invention, is economically profitable and readily adaptable for application. The yield of good billets is 82 to 92 percent.

What is claimed is:

1. A method of making billets, comprising the steps of forming a composite billet having a central portion and at least three ray members disposed symmetrically relative to the central longitudinal axis of said composite billet; each ray member being partially defined by a pair of opposed bases, a first one of which is situated at the juncture of the ray member with the central portion of said composite billet and a second one of which is situated at the side of the ray member opposite to the first base; providing that the ray members of said composite billet are free of any zone in which chemical constituents are segregated by forming each ray member with the first base of each ray member at the place of its juncture with the central portion of said composite billet being 0.72 to 2.3 times the height of said ray member, the second base being 0.5 to 1.0 times the height of said ray member so that any such segregation zone is localized in the central portion of said composite billet; forming stress raisers in the form of indentations at the region of the juncture of respective pairs of adjacent ray members, said indentations having a depth of about 0.07 to 0.2 times the height of the ray member and having a width of about 0.02 to 0.1 times the height of the ray member; and concurrently severing said ray members of the composite billet from said central portion.

2. A method of making billets as claimed in claim 1, wherein the composite billet is formed with four ray members including two pairs of oppositely spaced ray members and wherein two oppositely spaced ray members are initially severed from the composite billet, the severing operation being effected by means of shearing strain created by the rolls of a rolling mill, whereupon the two remaining said ray members are severed from said central portion.

3. A method of making billets as claimed in claim 2, wherein the relationship of the height dimensions of a pair of mutually perpendicular ray members is 1.05 to 1.5, wherein the two smaller-in-height oppositely spaced ray members are severed concurrently with the reduction of the remainder portion of the billet.

4. A method of making billets as claimed in claim 1, wherein prior to producing said composite billet, forming a continuous casting of rectangular cross section with the ratio of the sides thereof being 1.0 to 1.8, and rolling said continuous casting to form the same into a composite billet with four ray members with the relationship of axial dimensions of the mutually perpendicular ray members being 1.0 to 2.8, whereupon said ray members are severed from the central portion of said composite billet.

5. A method of making billets as claimed in claim 1, wherein after removing said segregation zone from said ray members of the composite billet, and prior to severance, each of said ray members is reduced by 10 to 30 percent in the axial direction, and while introducing the segregation zone into said ray member, the central portion of said composite billet is subjected to reduction simultaneously with said ray member, whereupon the ray members obtain a height which is 1.02 to 1.5 times the original height.

6. A method of making billets as claimed in claim 1, wherein prior to producing the composite billet, forming a continuously-cast slab whose sides are in the ratio of 1.05 to 2.0, reducing the continuously-cast slab in the area where segregation is concentrated so that said segregation zone is localized in said central portion and has a thickness 0.3 to 0.1 times the thickness of said slab, whereupon said ray members of the composite billet are severed from said central portion.

7. A method of making billets, comprising the steps of forming a composite billet having a central portion and three ray members disposed symmetrically relative to the central longitudinal axis of said composite billet so that the ray members of said composite billet are free of any zone in which chemical constituents are segregated and that any such segregation zone is localized in the central portion of said composite billet; forming stress raisers in the form of indentations at the region of the juncture of respective pairs of adjacent ray members, said identations having a depth of about 0.07 to 0.2 times the height of the ray member and having a width of about 0.02 to 0.1 times the height of the ray member; severing said ray members from said central portion, said severing operation being conducted in two stages comprising initial severing of two said ray members and subsequent severing of said central portion from the remaining ray member.

8. A method of making billets as claimed in claim 7, including the further step of preliminarily forming the composite billet such that two of said ray members are turned relative to the third member until the composite billet has a substantially T-shaped cross-section, whereupon the two turned ray members are then severed from said T-section by shifting the same relative to the remainder portion of said T-section, whereupon said central portion of the composite billet is severed from the remaining ray member.

9. A method of making billets, comprising the steps of forming a composite billet having a central portion and ray members symmetrically disposed relative to the central longitudinal axis of said composite billet so that the ray members of said composite billet are free of any zone in which chemical constituents are segregated and that any such segregation zone is localized in the central portion of said composite billet; forming stress raisers in the form of indentations at the region of the juncture of respective pairs of adjacent ray members, said indentations having a depth of about 0.07 to 0.2 times the height of the ray member and having a width of about 0.02 to 0.1 times the height of the ray member; severing said ray members from said central portion of said composite billet successively one after another by urging one of the lateral sides of one of said ray members against a grooved roll to shift the ray member.

10. A method of making billets as claimed in claim 9, wherein after shifting said ray member for a distance equal 0.57 to 0.92 times the height of said ray member the shifting direction is reversed.

* * * * *